US006168385B1

(12) United States Patent
Clamp

(10) Patent No.: US 6,168,385 B1
(45) Date of Patent: Jan. 2, 2001

(54) ROTARY DEVICE WITH MEANS FOR MONITORING AND ADJUSTING THE CLEARANCE BETWEEN THE ROTORS

(75) Inventor: John H. Clamp, Harpenden (GB)

(73) Assignee: Rotary Power Couple Engines Limited, Linton (GB)

( * ) Notice: Under 35 U.S.C. 154(b), the term of this patent shall be extended for 0 days.

(21) Appl. No.: 09/371,839

(22) Filed: Aug. 11, 1999

Related U.S. Application Data

(63) Continuation of application No. PCT/GB98/00423, filed on Feb. 11, 1998.

(30) Foreign Application Priority Data

Feb. 11, 1997 (GB) ..... 9702760

(51) Int. Cl.[7] ..... F04B 49/10

(52) U.S. Cl. ..... 417/9; 417/274; 418/2; 418/83

(58) Field of Search ..... 417/9, 228, 274; 418/2, 83, 191

(56) References Cited

U.S. PATENT DOCUMENTS

| | | | | |
|---|---|---|---|---|
| 3,746,481 | * | 7/1973 | Schippers | 418/83 |
| 4,804,905 | * | 2/1989 | Ding et al. | 324/61 P |
| 5,101,165 | * | 3/1992 | Rickards | 324/662 |
| 5,329,900 | | 7/1994 | Dye . | |
| 5,454,700 | | 10/1995 | Iguchi et al. . | |
| 5,895,847 | * | 4/1999 | Steuer | 73/261 |

FOREIGN PATENT DOCUMENTS

| | | | | |
|---|---|---|---|---|
| 44 15 875 | | 11/1994 | (DE) . | |
| 560 462 | | 9/1993 | (EP) . | |
| 634 254 | | 3/1950 | (GB) | 418/2 |
| 1195368 | * | 6/1970 | (GB) | 418/2 |
| 1 195 368 | | 6/1970 | (GB) | 418/2 |
| 1 600 754 | | 10/1981 | (GB) . | |
| 2-301689 | * | 12/1990 | (JP) | 418/2 |
| 4-232395 | * | 8/1992 | (JP) | 418/2 |
| 91/06747 | | 5/1991 | (WO) . | |

OTHER PUBLICATIONS

Patent Abstracts of Japan, vol. oo6, No. 193, (M–160) Oct. 2, 1982, & JP 57 099294 A, Jun. 19, 1982.

Patent Abstracts of Japan, vol. 018, No. 079, (M–1557) Feb. 9, 1994, & JP 05 293522 A, Nov. 9, 1993.

Patent Abstracts of Japan, vol. 012, No. 331, (P–755, Sep. 7, 1988 & JP 63 094111 A, Apr. 25, 1988.

Patent Abstracts of Japan, vol. 095, No. 002, Mar. 31, 1995 & JP 06330875 A, Nov. 29, 1994.

Patent Abstracts of Japan, vol. 014, No. 501, (M–1043), Nov. 2, 1990 & JP 02–207187 A, Aug. 16,1990.

* cited by examiner

*Primary Examiner*—Timothy S. Thorpe
*Assistant Examiner*—Cheryl J. Tyler
(74) *Attorney, Agent, or Firm*—Pillsbury Madison & Sutro LLP

(57) ABSTRACT

A rotary device (11) has a first rotor (12) rotatable about a first axis and having at its periphery a recess (14). A second rotor (13) is counter-rotatable to said first rotor (12) about a second axis, parallel to said first axis, and has a radial lobe (15). The first and second rotors (12,13) are coupled for rotation and are intermeshed such that, for a portion of the rotation of the rotors (12,13), there is defined between the first and second rotors (12,13) a transient chamber of volume which progressively decreases on rotation of the rotors (12,13). Means (27,28) are provided for monitoring the clearance between the rotors (12,13). Means for adjusting the clearance between the rotors (12,13) are provided.

16 Claims, 4 Drawing Sheets

Resulting traces from Capacitance Test Rig

ROTARY DEVICE WITH MEANS FOR MONITORING AND ADJUSTING THE CLEARANCE BETWEEN THE ROTORS

This is a Continuation of: International Appln. No. PCT/GB98/00423 filed Feb. 11, 1998.

The present invention relates to a rotary device.

FIELD OF THE INVENTION

In WO-A-91/06747, there is disclosed a rotary device having interacting rotors which have a helical form in their axial direction.

BACKGROUND OF THE INVENTION

In an internal combustion engine using such a rotary device, there are separate rotary compression and expansion sections.

In a fluid compressor using such a rotary device, the rotor pairs serve to compress and deliver compressible fluids into receivers in which the receiver pressure is substantially greater than that of the fluid source. Power is supplied by an external prime mover in order to drive the rotor pair and thus to compress the fluid, raising its pressure from that of the supply source to that of the receiver.

The rotary device of this prior art provides for compression and expansion of gases by means of the interaction between a first recessed rotor and a second lobed rotor. The number of lobes and recesses on the rotors determines the required speed ratio between the rotors. Counter-rotation of the rotors is effected at the required speed ratio by meshing gear wheels which are integral with the rotor shafts and which maintain a fixed angular relationship between the rotors.

The interaction of the rotors takes place between a pair of close-fitting side walls. One of the side walls contains a port for delivery of the fluid charge either to or from the rotors depending on whether they are effecting compression or expansion of the charge. Provision is made for mechanical or liquid seals between rotor/rotor and rotor/stator elements to reduce or virtually eliminate gas leakage during the operation of these machines. However, it is difficult to ensure that such seals remain in position and are capable of effective operation over a useful life because of the nature of the interaction between the rotors. There are, in any event, considerable disadvantages in the use of such seals due to the mechanical friction to which they give rise. On the other hand, there are substantial gains of efficiency when the leakage is contained to very low levels in the absence of seals, by providing for extremely small clearances between rotor/rotor and rotor/stator interfaces. The restricted gas leakage across the small clearances takes place in response to the pressure differential across the leak path only during the very brief periods of the cycle when such pressure differentials exist.

Intermeshing rotor components can be manufactured to within sufficiently restricted design tolerances such that leakage rates are within acceptable limits, provided that the clearances can be maintained during operation of the machine. However, components are subject to change of size and shape during operation due to the effects of heat and pressure. Clearances which are apparent when the machine is at rest and all components are uniformly at ambient temperature may change significantly during normal operation due to temperature differentials within and between components. These differentials are caused by local concentration of heat and the extent to which heated and cooled surfaces are separated, which give rise to the formation of temperature gradients.

If temperature changes and associated temperature gradients in one component are matched by equivalent changes of temperature and gradient occurring simultaneously in all components and all components have similar coefficients of thermal expansion, then no significant changes in clearance between the rotors will occur. However, in practice, it is most likely that differentials in temperature between components will occur, at least temporarily, thus causing changes in the clearance between the rotors. If the clearances are enlarged as a result, then the level of leakage may become unacceptably high. Conversely, if the clearances become too small, there is danger that the rotors may contact each other, which could result in structural failure.

SUMMARY OF THE INVENTION

According to a first aspect of the present invention, there is provided a rotary device, the device comprising: a first rotor rotatable about a first axis; a second rotor counter-rotatable to said first rotor about a second axis; the first and second rotors being coupled for rotation and being intermeshed such that, for a portion of the rotation of the rotors, there is defined between the first and second rotors a transient chamber of volume which progressively decreases on rotation of the rotors; and, monitoring means for monitoring the clearance between the rotors.

Thus, the present invention allows the clearance between the rotors to be monitored. In a preferred embodiment, as described below, the clearance can then be controlled so that the clearance is maintained within preset limits.

In a preferred embodiment, the monitoring means comprises capacitance monitoring means for monitoring the variation in capacitance between the rotors as the rotors rotate and as the clearance between the rotors varies.

Whilst monitoring the capacitance is the preferred manner of monitoring the clearance, other physical properties, and especially other electrical properties such as inductance, may alternatively be monitored to provide a measure of the clearance.

Means are preferably provided for adjusting the distance between the rotors if the clearance between the rotors falls outside a pre-set limit.

The rotors may be supportedly mounted in walls of a housing in which the rotors are contained, and the adjusting means may comprise heating means and cooling means for selectively heating and cooling at least a portion of the housing walls between said rotors to cause said portion to expand or contract thereby to adjust the distance between the rotors. The heating means may comprise an electrical heating element. The cooling means may comprise a passage in at least one of said walls for carrying a cooling fluid.

The rotors may be contained in a housing having walls which support the rotors, the rotors being supported by bearings which are mounted in the housing walls, the bearings being translatable to adjust the distance between the rotors.

The bearings can conveniently be eccentrically rotatably mounted in the housing walls, the bearings being eccentrically rotatable thereby to adjust the distance between the rotors.

It will be understood that both the heating and cooling means and the translatable bearings may be provided in the rotary device. Adjustment of the distance between the rotors can be achieved by operation of the heating and/or cooling means or by means of the translatable bearings or by using both systems.

According to a second aspect of the present invention, there is provided a rotary device, the device comprising: a first rotor rotatable about a first axis; a second rotor counter-rotatable to said first rotor about a second axis; the first and second rotors being coupled for rotation and being intermeshed such that, for a portion of the rotation of the rotors, there is defined between the first and second rotors a transient chamber of volume which progressively decreases on rotation of the rotors; and, adjusting means for adjusting the distance between the rotors.

Thus, the clearance between the rotors of this aspect can be adjusted to an optimum value or to be within certain preset limits for example.

The rotors may be supportedly mounted in walls of a housing in which the rotors are contained, and the adjusting means may comprise heating means and cooling means for selectively heating and cooling at least a portion of the housing walls between said rotors to cause said portion to expand or contract thereby to adjust the distance between the rotors.

The heating means may comprise an electrical heating element.

The cooling means may comprise a passage in at least one of said walls for carrying a cooling fluid.

The rotors may be contained in a housing having walls which support the rotors, the rotors being supported by bearings which are mounted in the housing walls, the bearings being translatable to adjust the distance between the rotors.

The bearings may be eccentrically rotatably mounted in the housing walls, the bearings being eccentrically rotatable thereby to adjust the distance between the rotors.

Monitoring means for monitoring the clearance between the rotors may be provided.

The monitoring means may comprise capacitance monitoring means for monitoring the variation in capacitance between the rotors as the rotors rotate and as the clearance between the rotors varies.

In either aspect, the device may comprise means for outputting a warning signal if the clearance between the rotors falls outside a pre-set limit.

Means for stopping operation of the device if the clearance between the rotors falls outside a pre-set limit may be provided in either aspect.

In either aspect, the first rotor may have at its periphery a recess and the second rotor may have a radial lobe which is periodically received in said recess on rotation of the rotors to define at least in part the transient chamber.

In either aspect, said rotor recess and rotor lobe preferably extend helically in the axial direction.

The device of either aspect may be a compressor.

The device of either aspect may form a portion of an internal combustion engine.

It will be appreciated that, whilst the present invention has particular application to rotary devices of the type disclosed in WO-A-91/06747, it also has application to other rotary devices, including, for example, conventional screw-type compressors having interacting recessed and lobed rotors.

BRIEF DESCRIPTION OF THE DRAWINGS

An embodiment of the present invention will now be described by way of example with reference to the accompanying drawings, in which.

DETAILED DESCRIPTION OF THE INVENTION

Figure 2:
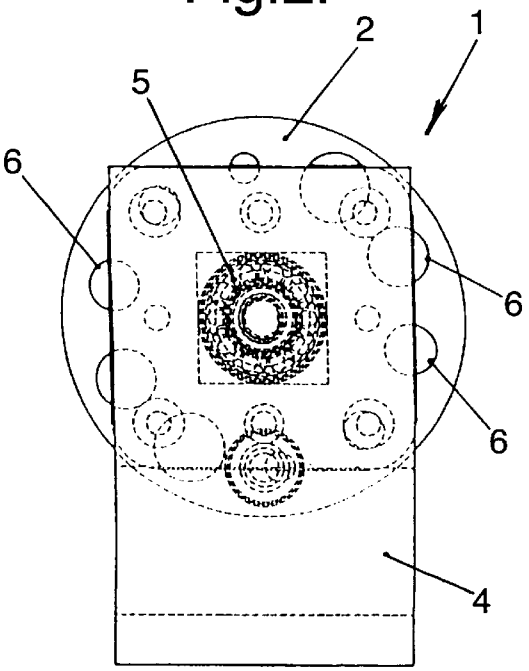
FIG. 2 is an end elevation of the test apparatus of FIG. 1.
Figure 1:
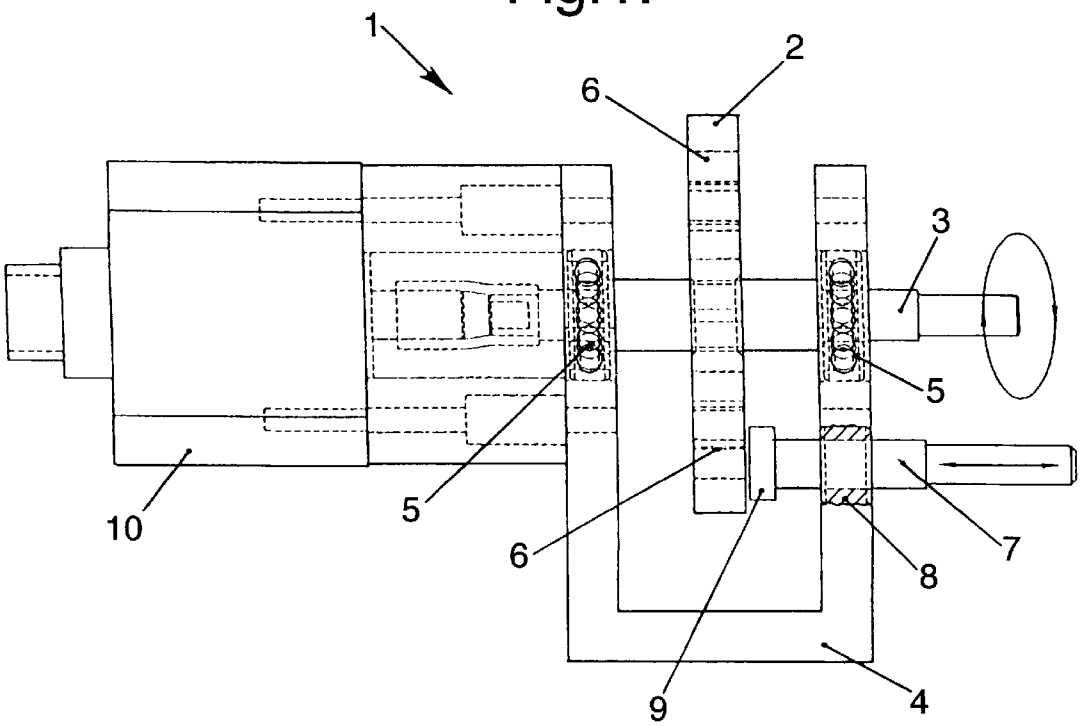
FIG. 1 is a side elevation of test apparatus for demonstrating the principles of the present invention.

In FIGS. 1 and 2, there is shown an example of test apparatus 1 to demonstrate the principles of the present invention. The test apparatus 1 simulates the generation of varying capacitance which occurs between the counter-rotating rotors of a rotary device to be described in more detail below. The test apparatus demonstrates the capability to monitor changes in capacitance which arise due to changes in clearance between the rotors during operation and to generate output signals which are capable of being used to effect control of the clearance between the rotors or to shut down the device if necessary.

The test apparatus 1 has a steel disc 2 which is mounted on a spindle 3. The spindle 3 is supported in a housing 4 of U-shape cross-section. Steel ball bearings 5 support the spindle 3 in the housing 4. The spindle 3 can be rotated by hand or can be driven by a motor (not shown) as indicated by the arrow in FIG. 1. The steel disc 2 has plural through holes 6 of different diameters. The through holes 6 lie within an annular band around the disc 2.

A capacitance probe 7 is supported in the housing 4 via an insulating threaded nylon bush 8. The capacitance probe 7 is mounted so that its flat sensor head 9 is located close to but not touching the adjacent surface of the disc 2. The capacitance probe 7 is spaced from the spindle 3 of the disc 2 by a distance such that the probe head 9 monitors the annular band of the disc 1 within which the through holes 6 lie. The diameter of the largest hole 6 in the disc 1 is slightly less than that of the probe head 9.

As the disc 2 rotates, the holes 6 pass closely over the surface of the probe head 9. The capacitance level detected by the probe 7 varies in proportion to the size of the hole 6 which currently faces the probe head 9 as the capacitance depends on the area of the two metal surfaces (i.e. the surface of the disc 2 and the probe head 9) which are in close proximity.

Figure 3:
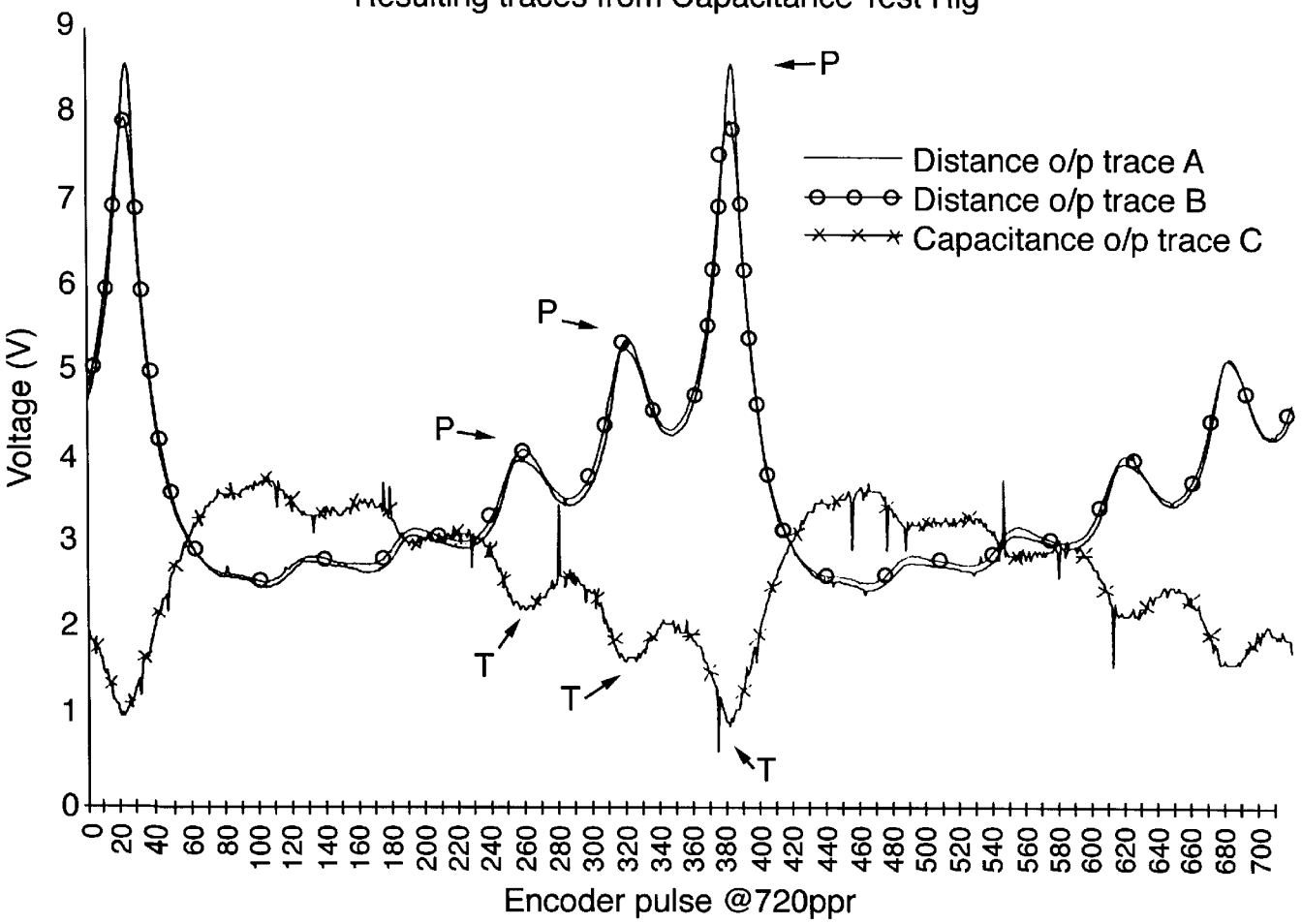
FIG. 3 is a diagram showing a graph of the output of the test apparatus of FIGS. 1 and 2.

The output of the capacitance probe 7 can be displayed on an oscilloscope either directly as capacitance or in the invert form (i.e. reciprocal value) as a voltage level equivalent to the distance between the probe head 9 and the disc 2. Examples of the output traces are shown in FIG. 3 in which trace C records capacitance and traces A and B are invert traces with values multiplied by 10. The trace A shown by a solid line represents the output (inverted) of the capacitance probe 7 when the disc 2 is rotated by hand. The trace B indicated by a circled line represents the output (inverted) of the capacitance probe 7 when the disc 2 is rotated by a motor at 3000 rpm. The corresponding capacitance is indicated by the trace C shown by a crossed line. The peaks P in the traces A and B and the troughs T in the capacitance trace C correspond to a hole 6 being adjacent the probe head 9, the level of the peak P or trough T being in accordance with the diameter of the hole 6 currently adjacent the probe head 9.

To demonstrate further the viability and accuracy of the measurement of the varying capacitance as the disc 2 rotates, an estimate of the diameters of the holes 6 was made from the output of the capacitance probe 9. The estimated values for the diameters of the holes 6 were checked against the real, measured values. The accuracy for all holes 6 was found to be on average within 4% and the accuracy was within 1.5% for most of the holes 6. The accuracy is in fact greater than these values indicate as the smallest hole 6 is of such small dimension that circumferential or edge effects distort the estimate. The accuracy of the estimation of the diameters of the holes 6 demonstrates the ability of the system to monitor accurately the varying capacitance produced by at least one rotating element and which varies in a characteristic repetitive cyclical fashion.

In the test apparatus, a shaft encoder 10 is driven by the spindle 3 and produces 720 pulses per revolution. A data acquisition system (not shown) digitises the analogue voltage signal output by the capacitance probe 7 whenever a pulse is received from the shaft encoder 10 and the resultant digitised value is stored in the memory of a computer. In a practical rotary device, to be described below, this technique enables a base data set to be loaded into the computer memory when the initial actual rotor clearances have been established by physical measurement, so that it can be used as a comparator for each subsequent data set collected during operation of the rotors of the device. The computer is able to calculate departures from the base data set clearance with great accuracy during real-time operation. If clearance values which are outside pre-set limits occur, then the computer can be used to output a signal to provide a warning, to trigger shut down of the system driving the rotors, or to control the clearance between the rotors as will be described further below.

Figure 4:
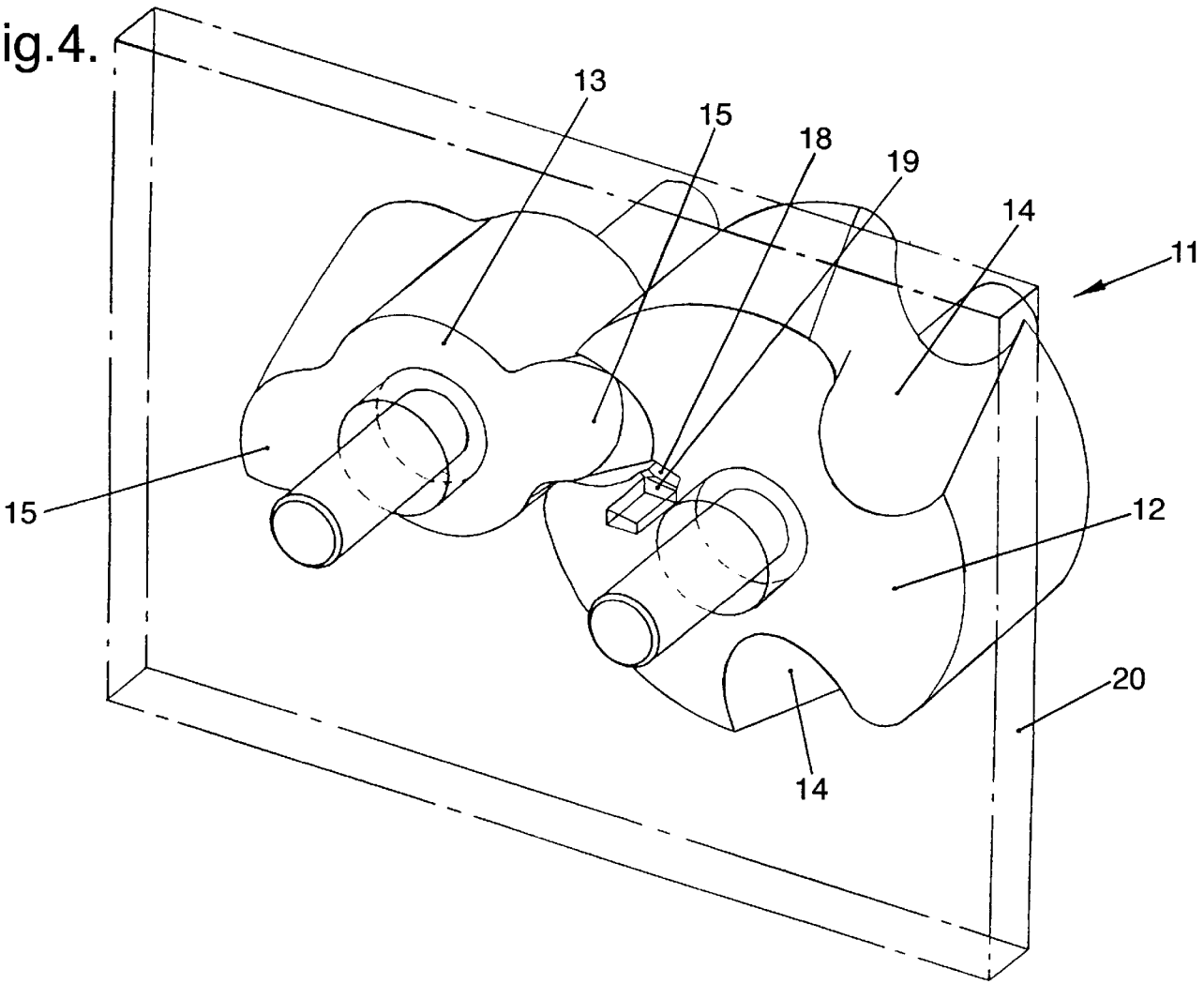
FIG. 4 is a perspective view of an example of a rotary device according to the present invention.

A portion of an example of a rotary device 11 is shown in FIG. 4. The basic principles of the rotary device 11 are disclosed in WO-A-91/06747. As such, the rotary device 11 has two counter-rotating rotors 12,13. The first rotor 12 has three equiangularly spaced recesses 14 provided at its periphery. The second rotor 13 has two diametrically opposed lobes 15 extending therefrom. The lobes 15 fit into and cooperate with the recesses 14 of the first rotor 12. The rotors 12,13 are keyed together by gears 16,17 in a speed ratio of whole numbers. In the example shown, where the first recessed rotor 12 has three recesses 14 and the second lobed rotor 13 has two lobes 15, the speed ratio between the rotors 12,13 is 2:3. Also shown in FIG. 4 is a delivery port 18 and a delivery passage 19 located in a side wall 20 which supports the rotors 12,13. After compression in a transient chamber created between a lobe 15 and a recess 14 as the rotors 12,13 rotate, the compressed fluid is passed through the delivery port 18 and passage 19. In the case of the rotary device 11 being used in an internal combustion engine, the passage 19 forms the combustion chamber. In the case where the rotary device 11 is used in a compressor, the passage 19 leads to a receiver for the compressed fluid. It will be appreciated that the other side wall 21 that supports the rotors 12,13 is not shown in FIG. 4.

Figure 5:
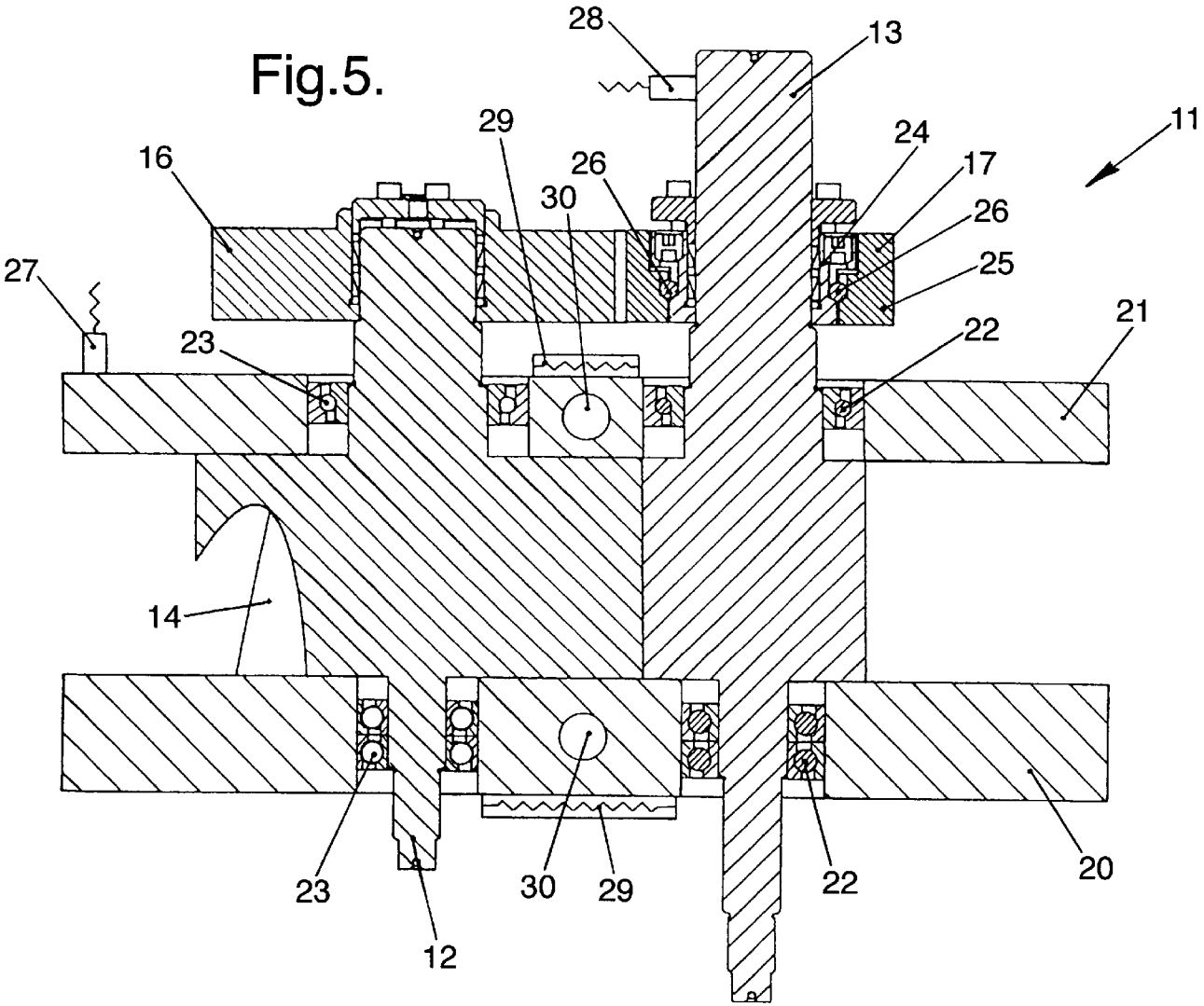
FIG. 5 is a cross-sectional view of the rotary device showing a first example of means for adjusting the clearance between the rotors; and, FIG. 6 is a perspective view of a second example of means for adjusting the clearance between the rotors.

In order to be able to measure the varying capacitance which occurs between the rotors 12,13 as the clearance between the rotors 12,13 varies and as the rotors 12,13 rotate, it is necessary to electrically isolate the rotors 12,13 from each other. As shown in FIG. 5, this can be achieved by supporting the lobed rotor 13 using ceramic ball bearings 22 in the housing walls 20,21. Alternatively, steel ball bearings could be used if fitted into a sleeve made of an insulating material, such as a phenolic material, and housed in the walls 20,21. The recessed rotor 12 is supported by steel ball bearings 23 in the housing walls 20,21. In addition, the gear 17 for the lobed rotor 13 is divided so as to have an inner section 24 and an outer section 25. The inner gear section 24 is fixed to the lobed rotor 13 and is electrically insulated from the outer gear section 25 by ceramic balls 26. Thus, the gears 16,17 are electrically isolated from each other so that the rotors 12,13 are electrically isolated from each other. It will be understood that the recessed rotor 12 could be mounted using ceramic ball bearings and its gear 16 can be divided as described above for the lobed rotor 13 and its gear 17, and the lobed rotor 13 can be mounted using steel ball bearings.

Monitoring of the capacitance between the rotors 12,13 is achieved by sliding contacts on the shaft of each rotor 12,13. Alternatively, where one rotor (in this example, the recessed rotor 12) is not electrically isolated from the housing walls 20,21, one electrical contact 27 can be mounted on a convenient place on one of the housing walls 20,21 and the other sliding contact 28 can be mounted on the shaft of the lobed rotor 13.

As described above, the varying capacitance between the rotating rotors 12,13 can be monitored. A base data set can be determined and stored in a computer memory and the actual measured capacitance can be compared with the base data set. If it is determined from this comparison that the clearance between the rotors moves outside pre-set limits (whether the clearance is greater than some upper limit or less than some lower limit), the computer monitoring the clearance can output a suitable signal. The signal can be used for example to provide a warning, to trigger shutdown of the system which drives the rotors 12,13 (for example, in the case of a compressor), or can be used to control the clearance between the rotors 12,13.

Adjustment of the clearance between the rotors 12,13 can be effected independently of changes of size of the rotors 12,13 which may occur due to the effects of temperature, pressure, or centrifugal stress. The clearance between the rotors 12,13 can be adjusted by changing the centre distance between the shafts of the rotors 12,13.

An example of means for varying the centre distance between the shafts of the rotors 12,13 is also shown in FIG. 5. Heating means, such as electrical heating elements 29, are fixed to the housing side walls 20,21 which support the rotors 12,13 in the region between the rotors 12,13. The power supply to the heating elements 29 can be controlled by the computer which monitors the clearance between the rotors 12,13 so that the heating elements 29 can be used to heat the portions of the side walls 20,21 between the rotors 12,13 thereby to controllably drive the rotors 12,13 apart to increase the clearance between the rotors 12,13. Similarly, through passages 30 through which cooling liquid can flow under control of the computer are provided in the housing walls 20,21 in the regions between the rotors 12,13 so that said regions of the side walls 20,21 can be cooled so as to make them contract in order to reduce the clearance between the rotors 12,13.

An alternative means for varying the distance between the rotors 12,13 is shown in FIG. 6. In this example, the shafts of the rotors 12,13 are supported by respective bearings 31,32 each of which is mounted eccentrically in a rotatable disc 33,34. The discs 33,34 are themselves mounted for rotation in the housing side wall 20. The discs 33,34 have gear teeth 35 at their periphery. Respective left and right handed worm drives 36,37 are provided for the discs 33,34 and engage with the teeth 35 of the discs 33,34 so that the discs 33,34 can be rotated in opposite directions. A stepping motor 38 rotates the worm gears 36,37 under control by the computer which monitors the varying capacitance between the rotors 12,13. Because of the eccentric mounting of the rotor bearings 31,32 in their respective discs 33,34, rotation of the discs 33,34 causes the centre distance between the rotors 12,13 to be increased or decreased as required.

It will be appreciated that the mechanical system for varying the centre distance between the rotors 12,13 shown in FIG. 6 can be used in conjunction with the heating elements 29 and the cooling passages 30.

The present invention provides means for monitoring the changes in clearance between rotors 12,13 of a rotary device 11. The clearance between the rotors 12,13 can be adjusted when it is found that the clearance falls below some pre-set limit or exceeds some pre-set limit. This ensures that the rotary device 11 can operate efficiently at all times with minimal leakage of the gas being compressed and without requiring seals. Alternatively or additionally, a warning signal can be issued or the device 11 can be shut down when the pre-set clearance limits are exceeded.

An embodiment of the present invention has been described with particular reference to the examples illustrated. However, it will be appreciated that variations and modifications may be made to the example described within the scope of the present invention.

What is claimed is:

1. A rotary device comprising:

a first rotor rotatable about a first axis;

a second rotor counter-rotatable to said first rotor about a second axis;

the first and second rotors being coupled for rotation and being intermeshed such that, for a portion of the rotation of the rotors, there is defined between the first and second rotors a transient chamber of volume which progressively decreases on rotation of the rotors;

said intermeshing rotors having proximal surfaces defining a clearance therebetween;

said first and second rotors being subject to thermal expansion during operation of the rotary device such that said clearance between the rotors varies as a result of said thermal expansion; and a monitoring device for monitoring the varying clearance between the rotors while the rotors are rotating.

2. A rotary device according to claim 1, wherein the monitoring device comprises a capacitance monitor for monitoring the variation in capacitance between the rotors as the rotors rotate and as the clearance between the rotors varies.

3. A rotary device according to claim 1, comprising an adjuster for adjusting the distance between the rotors if the clearance between the rotors falls; outside a pre-set limit.

4. A rotary device according to claim 1, comprising means for outputting a warning signal if the clearance between the rotors falls outside a pre-set limit.

5. A rotary device according to claim 1, comprising means for stopping operation of the device if the clearance between the rotors falls outside a pre-set limit.

6. A rotary device according to claim 1, wherein the first rotor has at its periphery a recess and the second rotor has a radial lobe which is periodically received in said recess on rotation of the rotors to define at least in part the transient chamber.

7. A rotary device according to claim 6, wherein said rotor recess and rotor lobe extend helically in the axial direction.

8. A rotary device comprising:

a first rotor rotatable about a first axis;

a second rotor counter-rotatable to said first rotor about a second axis;

the first and second rotors being coupled for rotation and being intermeshed such that, for a portion of the rotation of the rotors, there is defined between the first and second rotors a transient chamber of volume which progressively decreases on rotation of the rotors; and, a monitoring device for monitoring the clearance between the rotors;

an adjuster for adjusting the distance between the rotors if the clearance between the rotors falls outside a pre-set limit;

wherein the rotors are supportedly mounted in walls of a housing in which the rotors are contained; and said adjuster comprising a heater and a cooler for selectively heating and cooling at least a portion of the housing walls between said rotors to cause said portion to expand or contract thereby to adjust the distance between the rotors.

9. A rotary device according to claim 8, wherein the heater comprises an electrical heating element.

10. A rotary device according to claim 8, wherein the cooler comprises a passage in at least one of said walls for carrying a cooling fluid.

11. A rotary device comprising:

a first rotor rotatable about a first axis;

a second rotor counter-rotatable to said first rotor about a second axis;

the first and second rotors being coupled for rotation and being intermeshed such that, for a portion of the rotation of the rotors, there is defined between the first and second rotors a transient chamber of volume which progressively decreases on rotation of the rotors; and, a monitoring device for monitoring the clearance between the rotors;

an adjuster for adjusting the distance between the rotors if the clearance between the rotors falls outside a pre-set limit; and wherein the rotors are contained in a housing having walls which support the rotors, the rotors being supported by bearings which are mounted in the housing walls, the bearings being translatable to adjust the distance between the rotors.

12. A rotary device according to claim 11, wherein the bearings are eccentrically rotatably mounted in the housing walls, the bearings being eccentrically rotatable thereby to adjust the distance between the rotors.

13. A method of operating a rotary device which has a first rotor rotatable about a first axis and a second rotor counter-rotatable to said first rotor about a second axis, the first and second rotors being coupled for rotation and being intermeshed such that, for a portion of the rotation of the rotors, there is defined between the first and second rotors a transient chamber of volume which progressively decreases on rotation of the rotors; the method comprising the steps of:

rotating the rotors;

monitoring the clearance between the rotating rotors; and, adjusting the distance between the rotating rotors to vary the clearance between the rotors.

14. A method according to claim 13, wherein the clearance between the rotors is monitored by monitoring the variation in capacitance between the rotors as the rotors rotate and as the clearance between the rotors varies.

15. A method according to claim 13, wherein the rotors are supportedly mounted in walls of a housing in which the rotors are contained and the rotary device includes a heater and a cooler for selectively heating and cooling at least a portion of the housing walls between said rotors, wherein the step of adjusting the distance between the rotating rotors is carried out by selectively heating and cooling at least a portion of the housing walls between said rotors to cause said portion to expand or contract thereby to adjust the distance between the rotors.

16. A method according to claim 13, wherein the rotors are contained in a housing having walls which support the rotors, the rotors being supported by bearings which are mounted in the housing walls, wherein the step of adjusting the distance between the rotating rotors is carried out by translating the bearings thereby to adjust the distance between the rotors.

* * * * *